US007243898B2

(12) United States Patent
McLean

(10) Patent No.: US 7,243,898 B2
(45) Date of Patent: Jul. 17, 2007

(54) MOULDING ACCESSORY AND METHOD OF USING SAME

(76) Inventor: Tom McLean, 1 Glen Ager Drive, Etobicoke, Ontario (CA) M9B 5L1

( * ) Notice: Subject to any disclaimer, the term of this patent is extended or adjusted under 35 U.S.C. 154(b) by 383 days.

(21) Appl. No.: 10/836,080

(22) Filed: Apr. 29, 2004

(65) Prior Publication Data

US 2005/0173613 A1 Aug. 11, 2005

(30) Foreign Application Priority Data

Feb. 6, 2004 (CA) ..... 2457155

(51) Int. Cl.
*B22D 5/00* (2006.01)

(52) U.S. Cl. ..... 249/91; 52/125.4; 249/96; 229/199

(58) Field of Classification Search ..... 249/91, 249/96, 97; 52/125.4, 125.5, 704, 707; 229/122, 199
See application file for complete search history.

(56) References Cited

U.S. PATENT DOCUMENTS

| | | | | | |
|---|---|---|---|---|---|
| 1,244,034 | A | * | 10/1917 | Cummings | 52/706 |
| 1,266,128 | A | * | 5/1918 | Kelly | 52/699 |
| 1,585,684 | A | | 5/1926 | Oppenheim | 206/521 |
| 1,787,030 | A | | 12/1930 | Andrews | 229/152 |
| 1,821,951 | A | * | 9/1931 | Thompson | 249/61 |
| 1,864,043 | A | | 6/1932 | Gruber | 249/32 |
| 2,097,682 | A | | 11/1937 | Andersen | 229/120.14 |
| 2,192,183 | A | | 3/1940 | Deutsch | 264/278 |
| 2,206,939 | A | | 7/1940 | Carilli | 249/31 |
| 2,775,019 | A | | 12/1956 | Bemis | 249/30 |
| 2,823,442 | A | | 2/1958 | Miller et al. | 249/178 |
| 2,874,512 | A | | 2/1959 | Joseph et al. | 446/106 |
| 2,881,501 | A | | 4/1959 | Raney | 249/175 |
| 2,892,238 | A | | 6/1959 | Budd | 249/32 |
| 2,916,909 | A | | 12/1959 | Miller | 52/323 |
| 3,024,513 | A | | 3/1962 | Shuxteau et al. | 249/134 |
| 3,109,217 | A | | 11/1963 | Kell | 249/176 |
| 3,159,945 | A | * | 12/1964 | Morte | 52/706 |
| 3,238,278 | A | | 3/1966 | Stark | 264/34 |
| 3,358,960 | A | * | 12/1967 | Oliver et al. | 249/175 |
| 3,562,979 | A | | 2/1971 | Ali-Oglu | 52/125.5 |
| 4,685,267 | A | | 8/1987 | Workman | 52/577 |
| 4,817,794 | A | | 4/1989 | Workman | 206/372 |
| 4,831,803 | A | | 5/1989 | Leonardis | 52/323 |
| 4,842,241 | A | | 6/1989 | Fitzgerald et al. | 249/50 |
| 4,984,401 | A | | 1/1991 | Baldino | 52/378 |
| 5,029,710 | A | | 7/1991 | Workman et al. | 206/503 |
| 5,240,225 | A | | 8/1993 | Workman et al. | 249/117 |
| 5,255,888 | A | | 10/1993 | Workman | 249/48 |
| 5,439,107 | A | | 8/1995 | Penet et al. | 206/292 |
| 5,447,290 | A | | 9/1995 | Workman | 256/59 |
| 5,934,036 | A | | 8/1999 | Gallagher, Jr. | 52/323 |
| 6,050,043 | A | | 4/2000 | Rosenblat et al. | 52/577 |

(Continued)

*Primary Examiner*—Robert B. Davis
(74) *Attorney, Agent, or Firm*—Vidas, Arrett & Steinkraus

(57) ABSTRACT

A moulding accessory to form a void around a recessed lifting loop in a moulded concrete product such as a concrete cladding panel. The moulding accessory is formed from a body which is sized and shaped to fit with said lifting loop. The body is hollow, but sufficiently strong to form the void when concrete is poured. The body permits access to the lifting loop without needing to remove the body from the void. A method of forming a concrete product is also disclosed.

16 Claims, 4 Drawing Sheets

U.S. PATENT DOCUMENTS

| | | | | |
|---|---|---|---|---|
| 6,085,478 | A | 7/2000 | Workman | 52/301 |
| 6,116,568 | A | 9/2000 | Rosenblat et al. | 249/184 |
| 6,289,638 | B1 | 9/2001 | Vasseur | 52/98 |
| 6,560,934 | B1 | 5/2003 | Workman | 52/126.1 |
| 6,662,514 | B2 | 12/2003 | Workman | 52/300 |
| 6,779,312 | B2 * | 8/2004 | Wright | 52/125.5 |
| 2001/0004824 | A1 * | 6/2001 | Hazama | 52/701 |

* cited by examiner

MOULDING ACCESSORY AND METHOD OF USING SAME

FIELD OF THE INVENTION

This invention relates generally to the field of moulded concrete products and in particular to a moulding accessory of the type that is used to form a void in a moulded concrete product.

BACKGROUND OF THE INVENTION

Modern building construction techniques focus on quick and efficient building designs which use low cost readily available materials. A particular type of building design which is popular for commercial and industrial buildings consists of an internal steel framework on which cladding is mounted to form the building enclosure. Although various types of cladding can be used, one preferred type of cladding is concrete panel cladding. These concrete panels can be moulded or pre-cast in advance, and then erected onto the metal frame at the building site. Alternatively, these concrete panels may be cast on the site and once sufficiently cured, erected in place on the building frame.

Such concrete panels come in a variety of sizes with many different types of exterior finishes. To produce such panels requires an appropriately sized and shaped mould in order to produce the desired size and shape of panel. The panels may be pre-tensioned, post-tensioned or otherwise reinforced with reinforcing steel. The panels are placed side by side and one on top of another in order to form an external skin on the building. They may be placed on bracket mounts and are bolted or otherwise attached to the metal framework.

The panels are typically made in advance and stored until needed. This means that the panels must be manoeuvrable. However, it is more efficient to have several large panels rather than many small ones. Therefore, the panels tend to be large and can weigh thousands of pounds. Typically, lifting loops are provided on the panels to permit the panels to be lifted by lifting equipment and positioned in place. However, since the panels must sit side by side and one on top of another, such lifting loops are typically recessed and formed within a void space in the edges of the panel, to permit the panels to be butted up close one to another. In order to fit a lifting hook into the lifting loop the void is necessary around the recessed lifting loop. Recessed lifting loops may be provided on the top, bottom sides or ends of the panel. Typically, at least two recessed lifting loops are provided on a side, and a single recessed lifting loop is provided along a top edge. This permits the panel to be lifted by a series of lifting hooks which hold the panel in a stable manner to permit it to be easily positioned by the lifting equipment, such as a crane, onto a vehicle carrier and then eventually in place on the exterior of a building.

In the past, shaped Styrofoam® has been used during the moulding step to form a void around the recessed lifting loops. The Styrofoam® however, while providing an adequate sized and shaped void space, is messy, expensive and awkward to use.

Typically what is required is to obtain large sheets of Styrofoam® from a Styrofoam® supplier which are then individually cut into the necessary void shape. Cutting Styrofoam® sheets takes time, and typically creates highly statically charged particles which tend to stick to all surfaces. As a result, Styrofoam® particles can become stuck to surfaces of the concrete where they can create blemishes if not removed prior to the concrete setting.

A further problem of the Styrofoam® inserts is that they are difficult and awkward to remove from the cured concrete product. Essentially, the Styrofoam® needs to be chipped out of the void by hand, which creates additional electro static debris and is messy, time consuming and expensive. Further, the concrete is rough and workers can scrape their hands as they pick the Styrofoam® out of the finished product in order to create the intended void. Even once removed, the broken bits of Styrofoam® need to be swept up and disposed of, which is both time consuming and expensive.

SUMMARY OF THE INVENTION

What is needed is a more efficient way to form voids around recessed lifting hooks that are formed in moulded concrete products, such as cladding panels. In circumstances where the lifting hook is not recessed, no void is required. However, as with concrete panels which are intended to abut and be placed closely adjacent to one another, the lifting loops must be recessed so that the lifting loops do not interfere with abutting placement of adjacent panels. In this case, a void needs to be formed around the recessed lifting loop sufficient to permit a lifting hook to be placed under the lifting loop to permit lifting equipment to lift the moulded concrete product.

What is desired is a moulding accessory to form the void around the recessed lifting loop which is inexpensive and easy to use. What is further desired is for the moulding accessory to be sized and shaped to fit around the lifting loop before the concrete is completely poured. The body of the accessory needs to be sufficiently strong to resist the pressures of the concrete as the concrete is poured around the moulding accessory. Further, the moulding accessory should be usable without creating a lot of unnecessary and hard to deal with dust or garbage. Ideally the moulding accessory will not create any waste whatsoever. Lastly, the moulding accessory should be quick to implement to avoid the labour expense and risk of injury associated with picking apart the Styrofoam® material used to form voids of the prior art.

Therefore, according to one aspect of the present invention there is provided a moulding accessory for forming a void around a recessed lifting loop in a moulded concrete product, the moulding accessory comprising:

a body sized and shaped to fit with said lifting loop, said body being sufficiently rigid to form said void as said concrete is poured;

wherein said body permits a lifting means to access said recessed lifting loop without needing to remove said body from said void.

BRIEF DESCRIPTION OF THE DRAWINGS

Reference will now be made, by way of example only, to preferred embodiments of the invention with reference to the following figures.

DETAILED DESCRIPTION OF THE PREFERRED EMBODIMENTS

Figure 1:
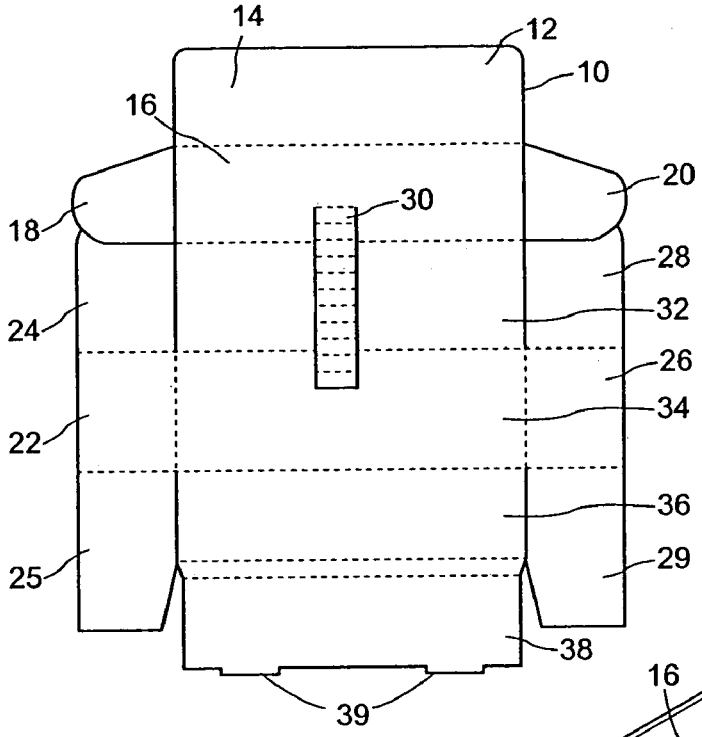
FIG. 1 is a top view of a blank of the present invention.

A moulding accessory 10 according to the present invention is shown in an unfolded position in FIG. 1. The moulding accessory 10 is preferable formed in the form of a blank, from a suitable flat bendable sheet material. The preferred sheet material is corrugated cardboard, which may be treated, coated, sprayed or otherwise rendered resistant to water and pourable concrete. Other materials such as plastics or laminates may also be used, but may be more expensive. Thus, where cost is a primary concern, corrugated cardboard achieves reasonable results.

The moulding accessory 10 is formed from a single sheet of material 12 which includes a number of elements. In FIG. 1, dashed lines represent fold lines, whereas solid lines represent cut lines. Most preferably the blank is formed by a single die cut from a large sheet of material. Beginning at the top of the figure, there is provided a lengthwise tongue 14, a bottom panel 16, and side tongues 18 and 20. A tab 30 is also provided which is explained in more detail below. End panel 22, and interior folded walls 24 and 25 on one side are symmetrically disposed with end panel 26, and interior folded walls 28 and 29 on the other side. Front panel 32, top panel 34 and folding back panel 36, and fold over panel 38 complete the blank for the moulding accessory 10. The panel 38 may include raised tabs 39 to help the panel 38 stay in place in a known manner. The terms front, back, top and bottom as used herein are with respect to the position of the moulding accessory 10 when placed in a panel being cast on its side. These terms are used for reference only and are not intended to be limiting to this particular orientation.

Figure 3:
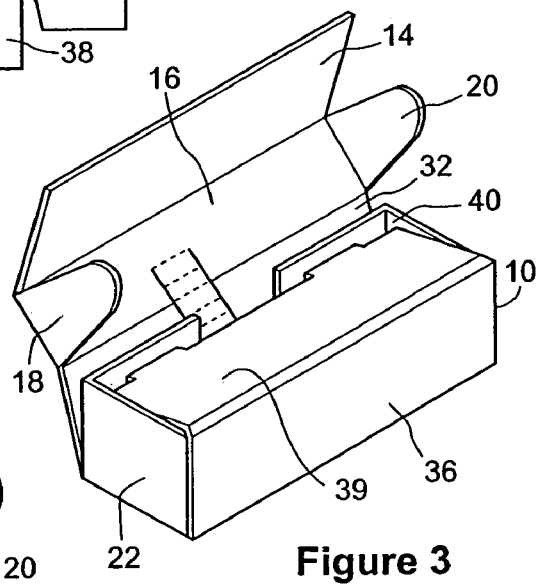
FIG. 3 is a view of the blank of FIGS. 1 and 2 in a more fully folded position.
Figure 2:
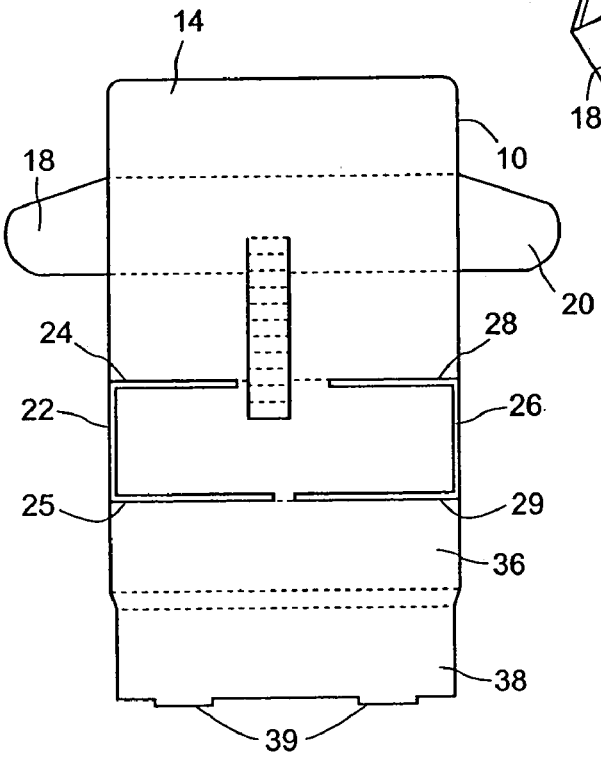
FIG. 2 is a view of the FIG. 1 with side portions folded up.
Figure 4:
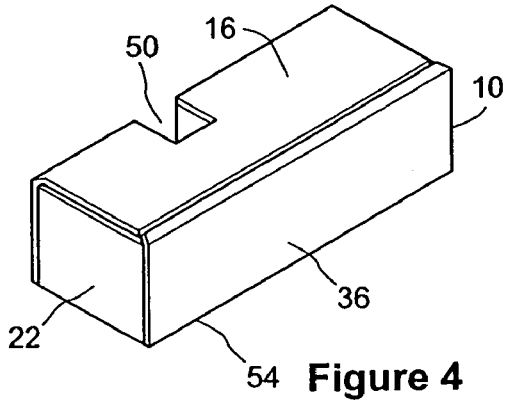
FIG. 4 is a view of the blanks of FIGS. 1, 2 and 3 in a fully folded position.

Turning to FIG. 2, panels 22, 24 and 25, as well as 26, 28 and 29 have been folded up to form ends of the moulding accessory body. In FIG. 3, tongue 14 and panel 16 have been folded over and the tongues 18, 20 have also been folded over and are ready for insertion into a body 40. In FIG. 4 the body 40 is fully formed with the tongues being inserted into the appropriate openings. As will now be appreciated the body 40 is hollow but structurally integral by means of the folds, and the choice of material.

As can be seen in FIG. 4, the moulding accessory takes the form of a rectangular hollow box, which includes a notch 50. The notch 50 is formed by the tab 30 which is loosely covering the notch 50. The tab 30 is attached at one end and is free at the other end. The tab 30 includes a plurality of folds so it may be bent to form a smooth curve. The width of the tab 30 and consequently the notch 50 is sized to correspond to the width of steel used to make a lifting loop in the concrete product. In this manner, the present invention is sized and shaped to fit under and around the lifting loop as explained in more detail below.

Also from FIG. 4, it can be seen that the notch 50 is preferably located closer to one end of the body than the other. This is because the void formed by the moulding accessory 10 is intended to accommodate a lifting hook. The entire width of the lifting hook needs to pass on one side of the notch 50, but only the hook portion of the lifting hook needs to pass on the other side of the notch 50. Therefore, it is preferable to make the void larger on the hook insertion side to permit the hook to easily be fit around the lifting loop.

Figure 5:
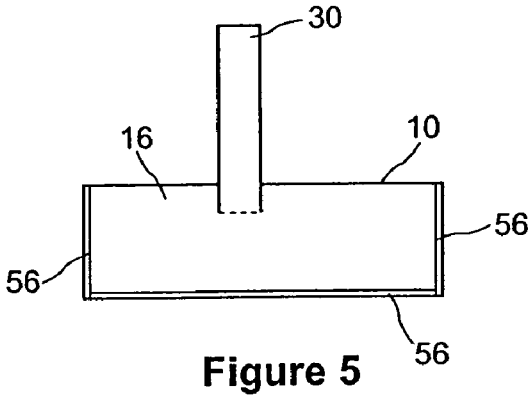
FIG. 5 is a bottom view of the present invention in a fully folded position.
Figure 6:
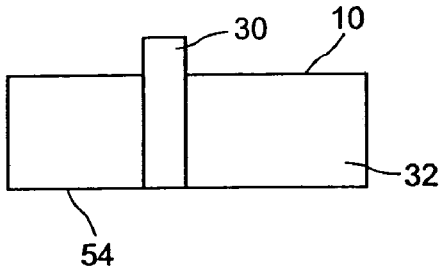
FIG. 6 is a front view of the invention of FIG. 5.

Turning to FIG. 5, a rear view is shown with the tab 30 extending from the body of the moulding accessory 10. FIG. 6 shows the moulding accessory 10 from a different perspective. In FIG. 6 the seamless folds are shown at 54, while in FIG. 5, the seams are shown at 56.

Figure 7:
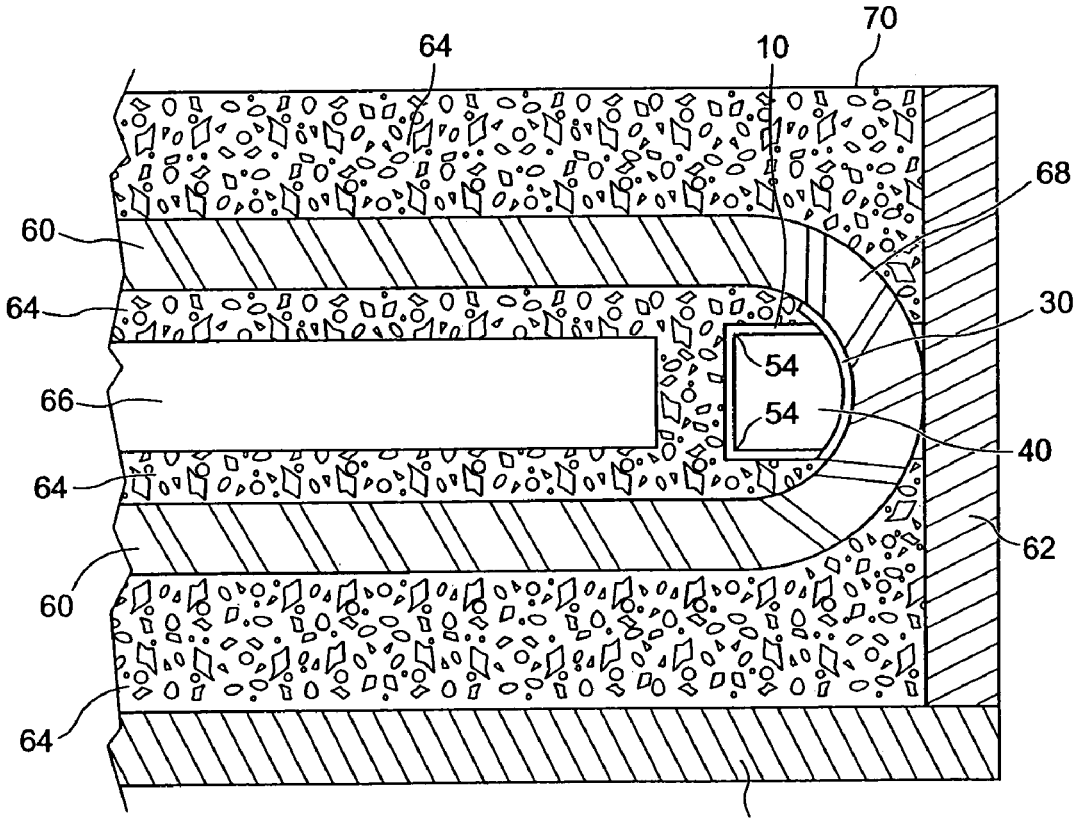
FIG. 7 is a side view of the present invention in a mould.

Turning now to FIG. 7, the mould is formed by mould plates 60 and 62. The concrete is shown as 64 and a Styrofoam® spacer 66 is also shown forming the middle of the panel. The lifting loop 68 is formed by a bent piece of reinforcing bar 60 which is moulded into place in the concrete moulded product 70. As can be seen, the lifting loop 68 does not extend beyond the top surface of the moulded product as defined by moulding plate 62, and thus is recessed within an edge of the panel.

As will be understood by those skilled in the art, the panel is typically formed in multiple step moulding process. In a first step, a portion of the panel is made, at which time the elements such as the lifting loop 68 may be set in place. The lifting loop 68 may be made from bent steel, but may be also any other type of fitting which permits a hook to be used to lift the completed concrete product once set. Thus, the term lifting loop as used herein means any kind of lifting hardware whether loop shaped or not. Then, the moulding accessory 10 of the present invention can be inserted in place, and the remainder of the panel moulded.

The moulding accessory 10 according to the present invention is shown in cross-sectional view in FIG. 7. The lifting loop 68 is shown with the tab 30 extending across the slot 50. By reason of the lifting loop itself, flowable concrete is prevented from entering into the interior of the moulding accessory 10, hollow body 40 through the open sides of the notch 50. In this way, as concrete is poured around the moulding accessory 10, the moulding accessory 10 is able to create a void in the concrete. As can now be understood, it is most preferred to orient the hollow body 40 so that continuous fold edges are presented to an upstream direction with respect to concrete flow, and that the tucked in edges (which form an open seam) are placed underneath or positioned on the underside of the body when the concrete is poured around the body. This positioning reduces the chance that flowable concrete will penetrate the hollow body 40.

In some cases there may be two recessed lifting loops formed along one edge of a panel. In such cases it is preferred to form the larger part of the void closer to the middle of the panel, for strength and other reasons. To keep the seamless edge of the present invention in the proper position in this case requires the use of two separate blanks, that are mirror images of one another. This requires two separate parts, a left-hand and a right-hand part to mould voids for two such lifting hooks, for example, along a side edge of a panel. Therefore the present invention further provides for markings on the blanks to assist in the folding of the blanks into the hollow void forming bodies. This marking may take the form of folding instructions, an indication of what is the inside or outside or merely marking the blanks as being left or right handed parts.

The next step of panel construction is to permit the second pour concrete to set and then once set, to raise or tilt the moulded concrete panel to an upright position after the form work is removed. At this time, according to the present invention the lifting loop is accessible to a lifting hook without requiring any further labourer steps. Although reference is made to the term lifting hook, this term comprehends any lifting means such as hooks, grapples, shackles or other lifting fittings or equipment. The benefits of the present invention can now be more fully appreciated. Rather than removing the void forming material as required in the prior art, according to the present invention, the moulding accessory 10 permits the lifting hook to be placed under the lifting loop without needing to remove the moulding accessory 10 from the moulded concrete product. Thus, the flexible cardboard is simply pushed, deformed or torn as the lifting hook is placed under the recessed lifting loop. The cardboard can remain inside of the recessed void in the lifting panel without needing to be removed. Even when the moulding accessory 10 is retained in the moulded concrete panel, access is available for the hook to engage the lifting loop.

It will now be appreciated that by forming the moulding accessory 10 as a hollow body, the body can, on the one hand hold up to the force of the poured concrete to reliably create a mould, while being collapsable by the force of the lifting hook on the other. The collapsing can be accomplished by the inherent flexibility of the sheet or cardboard material, by means of weakening perforations or by any other means that permits the void forming body to collapse out of the way. For example, for cardboard sheet material wetting can be used to reduce the strength of the material for easier hook penetration.

As can be seen from FIG. 7, the moulding accessory 10 according to the present invention presents one face to the mould plates which define the exterior surface of the moulded product. As the present invention provides a material which can be deformed out of the way to permit the lifting hook to reach under the lifting loop, there is no need to remove any material prior to being able to position the hook under the lifting loop. In this way, the present invention is much easier and quicker to use than the prior art, since there is no need to remove the moulding accessory prior to using the lifting hook to manipulate the moulded concrete product, nor is there hardly any debris, if any, produced to be cleaned up and disposed of.

Figure 8:
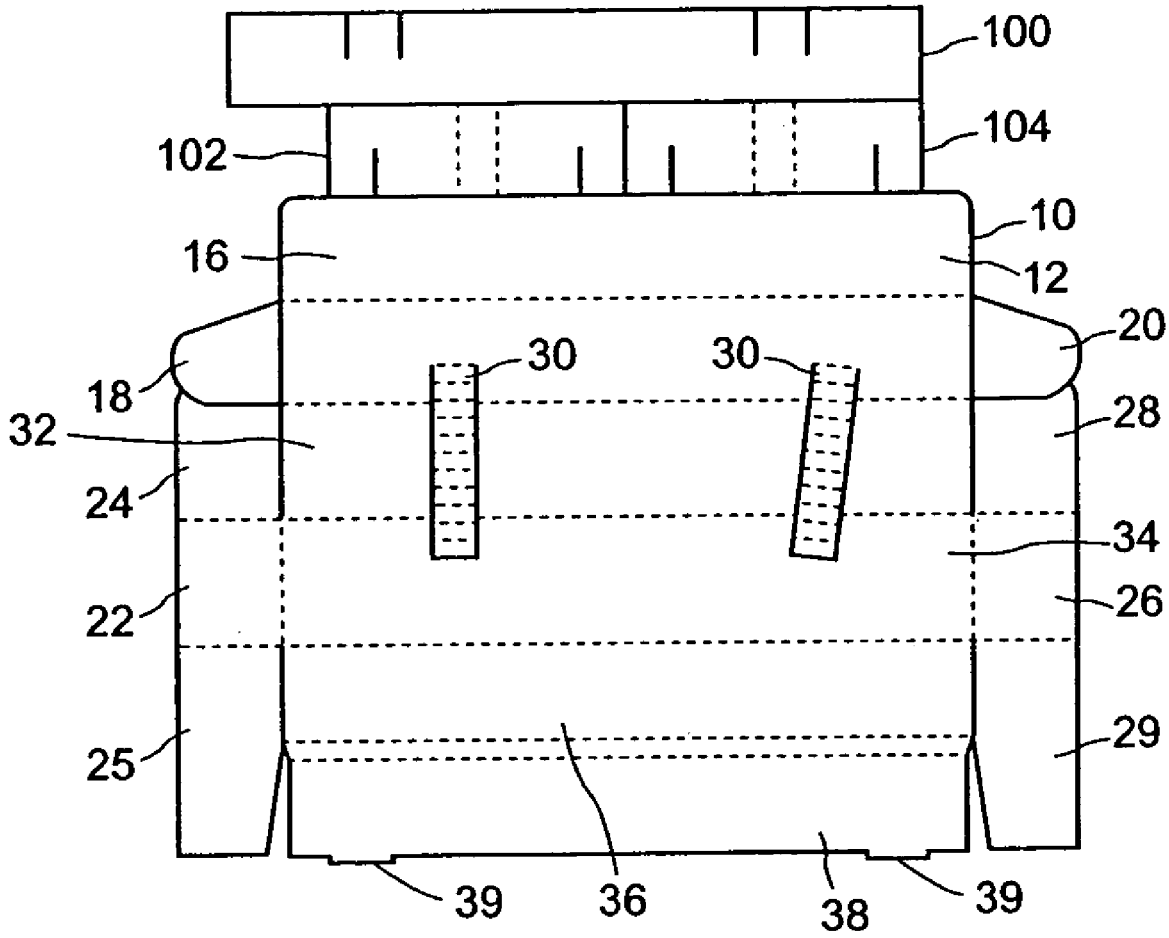
FIG. 8 is a blank of a second embodiment according to the present invention.

FIG. 8 is a die-cut blank for a second embodiment of the present invention. In this embodiment, provision is made for the void to be formed around two adjacent recessed lifting loops. Therefore, the second embodiment is similar to the first embodiment, except it includes two tabs 30 and two notches 50, rather than one. In over all size, the second embodiment is longer, but otherwise has the same cross-sectional area as the first embodiment.

Figure 9:
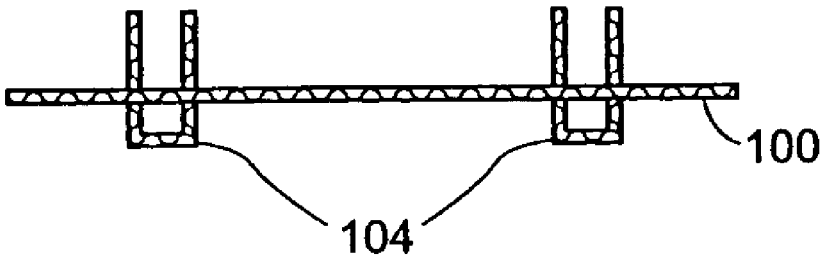
FIG. 9 is an isometric view of the reinforcing members of FIG. 8 in an assembled position.
Figure 10:
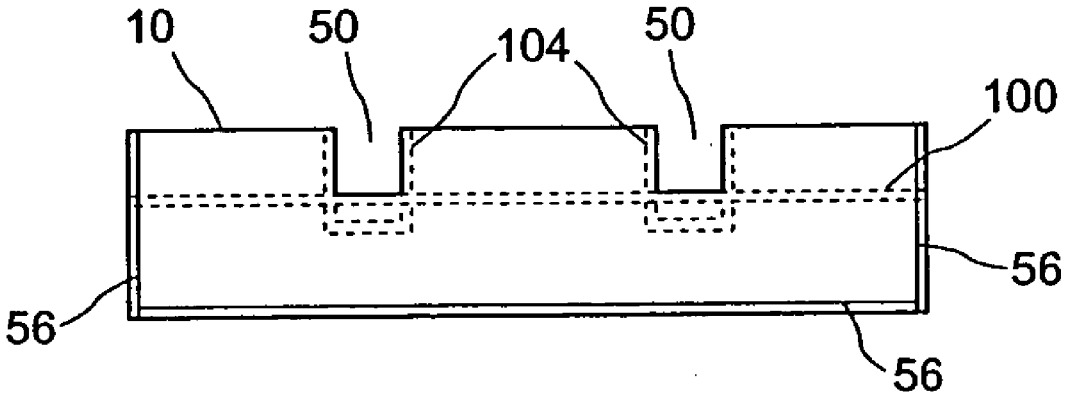
FIG. 10 is a side view of a hollow body according to the present invention with the reinforcing members in place around the openings.

Also shown in FIG. 8 are reinforcing members 100, 102 and 104. These can be easily separated from the remainder of the blank and interlocked to form a support grid 106 as shown in FIG. 9 which can be placed inside the hollow body 40. The grid acts to support the hollow body 40 to help resist the hollow body from being crushed inwardly by the poured concrete, which would close the void and perhaps prevent the lifting hook from fitting into the void under the loop. As well, these internal support walls are sized and shaped so they can be closely positioned around the notches 50 to help prevent concrete flow into the interior of the hollow body. This is shown in FIG. 10 where the member 100 is positioned just below the level of the side notch and the folded over elements 104 are sized to approximately complete an internal wall around the notches or openings 50. It will be understood that the reinforcing grid is optional, and its use will depend upon the size of the hollow body, and the depth of concrete that needs to be supported during moulding.

Although it will be appreciated that sizes can vary, depending upon the specific moulding requirements, good results have been achieved with a moulding accessory 10 having a cross-sectional area of between 6 cm and 10 cm wide by 7 cm to 11 cm high. The length can also vary, but can be 20 cm to 25 cm, for the first embodiment and 40 cm to 60 cm for the second embodiment. The width of the notch will be sized to closely receive the lifting loop 68, but 2.5 cm gives adequate results.

The benefits of the present invention can now be more fully understood. Firstly, the blanks can be delivered and easily stored flat, since they are compact and lie flat. As compared to Styrofoam®, the cardboard which folds into a hollow body occupies much less space in its flat form. Thus, saves on both shipping and handling expenses. Additionally, the blanks can be easily folded into shape, with a minimum of effort or skill. The folding can even be done by unskilled labourers who are, due to injury and the like, restricted to light duty work. The folding of a blank into a hollow body is quick and easy compared to cutting out a Styrofoam® shape, and thus, is less expensive and less messy. By reason of the notch 50, the present invention is easily and securely positioned in place in the mould, and by being flush against one side of the mould readily resists displacement during the concrete pour. Presenting the seamless edge to the concrete helps keep the hollow interior free of concrete. Once the concrete has set or is sufficiently cured to permit the concrete product to be moved, the hollow body is flexible or breakable, to permit a lifting hook to be used under the recessed lifting loop, without even needing to remove the moulding accessory 10 from the panel void. This is quicker, less messy and much less expensive than having to chip out, clean up and dispose of bits of Styrofoam®.

It will be appreciated by those skilled in the art that while preferred embodiments of the invention have been described, many variations are possible without departing from the broad scope of the claims which follow. Some have been described above and others will be apparent to those skilled in the art. For example, while corrugated cardboard has been used and provides adequate results, various other materials can be used to form a hollow body which can be used to form a void in a moulded product.

I claim:

1. A moulding accessory for forming a void around a recessed lifting loop in a moulded concrete cladding panel, the moulding accessory comprising:

a closed body sized and shaped to fit within said lifting loop said body being comprised of a series of folded over panels including a front panel, said body being sufficiently rigid to form said void as said concrete is poured around said body; and at least one notch within said closed body and across said front panel to closely receive said recessed loop to prevent concrete from flowing into said void through said notch, wherein said body is flexible to permit a lifting member to access said recessed lifting loop without needing to remove said body from said void.

2. A moulding accessory for forming a void around a recessed lifting loop in a moulded concrete product as claimed in claim 1, wherein said body is a hollow body formed of a sheet material.

3. A moulding accessory for forming a void around a recessed lifting loop in a moulded concrete product as claimed in claim 2 wherein said sheet material is corrugated cardboard.

4. A moulding accessory for forming a void around a recessed lifting loop in a moulded concrete product a claimed in claim 3 wherein said hollow body is a folded up one piece flat blank.

5. A moulding accessory for forming a void around a recessed lifting loop in a moulded concrete product as claimed in claim 4 wherein said hollow body includes seamless edges which are positioned to prevent concrete from flowing into said hollow body.

6. A moulding accessory for forming a void around a recessed lifting loop in a moulded concrete product claimed in claim 1 wherein said notch is sized and shaped wherein when said lifting loop is located within said notch said lifting loop substantially prevents flowable concrete from entering said hollow body through said notch.

7. A moulding accessory for forming a void around a recessed lifting loop in a moulded concrete cladding panel, the moulding accessory comprising:

a closed body sized and shaped to fit within said lifting loop said body being comprised of a series of folded over panels including a front panel, said body being sufficiently rigid to form said void as said concrete is poured around said body; and at least one notch within said closed body and across said front panel to closely receive said recessed loop to prevent concrete from flowing into said void through said notch, said notch is sized and shaped wherein when said lifting loop is located within said notch said lifting loop substantially prevents flowable concrete from entering said hollow body through said notch, wherein said body is flexible to permit a lifting member to access said recessed lifting loop without needing to remove said body from said void further including a tab to extend across said notch.

8. A moulding accessory for forming a void around a recessed lifting loop in a moulded concrete product as claimed in claim 7 wherein said tab is bendable into a curved shape to follow a curve of said lifting loop.

9. A moulding accessory for forming a void around a recessed lifting loop in a moulded concrete product as claimed in claim 1 wherein said notch is located closer to one end than to another end of said hollow body to form a larger void on one side of said recessed lifting loop than on the other side.

10. A moulding accessory for forming a void around a recessed lifting loop in a moulded concrete cladding panel, the moulding accessory comprising:

a closed body sized and shaped to fit within said lifting loop said body being comprised of a series of folded over panels including a front panel, said body being sufficiently rigid to form said void as said concrete is poured around said body; and at least one notch within said closed body and across said front panel to closely receive said recessed loop to prevent concrete from flowing into said void through said notch, said notch is sized and shaped wherein when said lifting loop is located within said notch said lifting loop substantially prevents flowable concrete from entering said hollow body through said notch wherein said body is flexible to permit a lifting member to access said recessed lifting loop without needing to remove said body from said void wherein said notch is located closer to one end than to another end of said hollow body to form a large void on one side of said recessed lifting loop than on the other side and wherein said hollow body is provided in a left and a right hand version.

11. A moulding accessory for forming a void around a recessed lifting loop in a moulded concrete product as claimed in claim 10 wherein said blanks are marked to indicate whether the blank is a left hand or a right hand blank.

12. A moulding accessory for forming a void around a recessed lifting loop in a moulded concrete product as claimed in claim 4 wherein said moulding accessory includes one or more portions that may be formed into reinforcing members to be placed with the folded hollow body.

13. A moulding accessory for forming a void around a recessed lifting loop in a moulded concrete product as claimed in claim 1 wherein said moulding accessory is formed from a sheet material selected from the group of cardboard, corrugated cardboard, plastic, plastic laminates and corrugated plastic laminates.

14. A moulding accessory for forming a void in a moulded concrete product, said moulding accessory comprising:

a generally closed hollow body sized and shaped to be positioned in a concrete mould adjacent to an exterior surface, said hollow body including a planar surface to abut a surface of said concrete mould;

said hollow body being configured to prevent flowable concrete from entering said hollow body when said flowable concrete is poured into said mould;

said hollow body including a transverse notch sized and shaped to permit a lifting loop to pass through said notch and below said planar surface;

wherein said planar surface of said hollow body is flexible to permit said lifting hook to be inserted under said recessed lifting loop without needing to remove said hollow body from said concrete moulded panel.

15. A moulding accessory for forming a void around a recessed lifting loop in a moulded concrete product, the moulding accessory comprising:

a closed hollow body formed of a sheet metal material sized and shaped to fit with said lifting loop, said body being comprised of a series of folded over panels including a front panel, said body being sufficiently rigid to form said void as said concrete is poured around said body, said body including at least one notch to closely receive said at least one recessed lifting loop, said notch being sized and shaped wherein when said lifting loop is located within said notch said lifting loop substantially prevents flowable concrete from entering said hollow body through said notch, further including a tab to extend across said notch;

wherein said body is flexible to permit a lifting member to access said recessed lifting loop without needing to remove said body from said void.

16. A moulding accessory for forming a void around a recessed lifting loop in a moulded concrete product, the moulding accessory comprising:

a closed hollow body formed of a sheet material, sized and shaped to fit with said lifting loop said body being comprised of a series of folded over panels including a front panel, said body being sufficiently rigid to form said void as said concrete is poured around said body, said hollow body including at least one notch to closely receive said at least one recessed lifting loop, said notch being located closer to one end than to another end of said hollow body to form a larger void on side of said recessed lifting loop than on the other side;

wherein said body is flexible to permit a lifting member to access said recessed lifting loop without needing to remove said body from said void; and wherein said hollow body is provided in a left hand and a right hand version.

* * * * *